United States Patent [19]

Wang et al.

[11] 4,139,481

[45] Feb. 13, 1979

[54] COMBINATIONS OF ALKYLAMIDOALKYL MONOESTERS OF SULFOSUCCINIC ACID AND FATTY ACIDS AS COLLECTORS FOR NON-SULFIDE ORES

[75] Inventors: Samuel S. Wang, Cheshire; Eugene L. Smith, Jr., Milford, both of Conn.

[73] Assignee: American Cyanamid Company, Stamford, Conn.

[21] Appl. No.: 862,992

[22] Filed: Dec. 21, 1977

[51] Int. Cl.[2] ..... B03D 1/02

[52] U.S. Cl. ..... 252/61; 209/166

[58] Field of Search ..... 252/61; 209/166 S

[56] References Cited

U.S. PATENT DOCUMENTS

| | | | |
|---|---|---|---|
| 2,236,528 | 4/1941 | Epstein et al. | 209/166 X |
| 2,377,129 | 5/1945 | Christmann et al. | 209/166 |
| 3,447,681 | 6/1969 | Ramirez | 209/166 |

FOREIGN PATENT DOCUMENTS

| | | | |
|---|---|---|---|
| 443682 | 9/1975 | U.S.S.R. | 209/5 |

*Primary Examiner*—Harris A. Pitlick

*Attorney, Agent, or Firm*—William J. Van Loo

[57] ABSTRACT

A combination of a fatty acid and an alkylamidoalkyl monoester of a sulfosuccinic acid or salt thereof provides improved recovery of non-sulfide ores by froth flotation.

4 Claims, No Drawings

COMBINATIONS OF ALKYLAMIDOALKYL MONOESTERS OF SULFOSUCCINIC ACID AND FATTY ACIDS AS COLLECTORS FOR NON-SULFIDE ORES

CROSS-REFERENCE TO RELATED APPLICATION:

This application is related to application Ser. No. 863,031 filed on even date herewith. The instant application relates to a combination of a fatty acid and an alkylamidoalkyl monoester of a sulfosuccinic acid or a salt thereof. The related application relates to a froth flotation process for beneficiating non-sulfide ores using the combination.

This invention relates to a collector combination for the beneficiation of non-sulfide ores. More particularly, this invention relates to such a collector combination comprising a mixture of a fatty acid and an alkylamidoalkyl monoester of a sulfosuccinic acid or salt thereof.

Froth flotation is the principal means by which phosphate, barite, fluorite, hematite, taconite, magnetite and a host of other ores are concentrated. Its chief advantage lies in the fact that it is a relatively efficient process operating at substantially lower costs than many other processes.

Flotation is a process for separating finely ground valuable minerals from their associated gangue, or waste, or for separating valuable components one from another. In froth flotation frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends upon the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practive of this invention is not limited, however, by this or other theories of flotation.

Phosphate rock is a typical example of a non-sulfide ore. Typically, phosphate ore containing about 15–35% BPL [bone phosphate of lime, $Ca_3(PO_4)_2$] is concentrated in very large tonnages from the Florida pebble phosphate deposits. The ore slurry from strip mining is sized at about 1 millimeter and the coarser fraction, after scrubbing to break up mud balls, is a finished product. The minus 1 mm. fraction is further sized at 35 to 200 mesh. The minus 200 mesh slime is discarded. From the sizing operation, the +35 mesh material in thick slurry is treated with fatty acid, fuel oil and caustic, ammonia or other alkaline material and the resulting agglomerates are separated on shaking tables, spirals or spray belts. The 35 × 200 mesh fraction is conditioned with the same type of reagents and floated by conventional froth flotation routes. Not all the silica gangue is rejected by the fatty acid flotation, so the concentrate is blunged with acid to remove collector coatings, deslimed, washed free of reagents and subjected to an amine flotation with fuel oil at pH b 7–8. This latter flotation, sometimes called "cleaning", removes additional silica and raises the final concentrate grade to 75–80% BPL.

Although the procedure described above is effective in the beneficiation of non-sulfide ores in general, there, nevertheless, exists the need for more effective collectors which provide increased recovery of non-sulfide minerals while still providing high grade. It is particularly desirable to reduce the requirements for fatty acids which are constantly being diverted to nutritional and other uses. In view of the high quantities of non-sulfide minerals processed by froth flotation, such a development can result in a substantial increase in the total amount of mineral values recovered and provide substantial economic advantages even when a modest increase in recovery is provided. It is also highly desirable to have an efficient collector system for use at reduced dosage levels without sacrificing the mineral recovery performance. The decreases in reagent consumption are significant in view of the increasing diversion of fatty acids to nutritional and other uses. Accordingly, the provision for an improved collector combination for froth flotation of non-sulfide minerals would fulfill a long-felt need and constitute a notable advance in the art.

In accordance with the present invention, there is provided a collector combination for non-sulfide minerals which comprises from about 1 to about 99 weight percent of a fatty acid derived from a vegetable or animal oil and, correspondingly, from about 99 to about 1 weight percent of an alkylamidoalkyl monoester or a sulfosuccinic acid of the general formula:

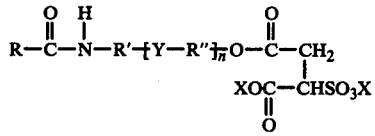

where R is an alkyl radical of about 4 to about 18 carbon atoms, R′ and R″ are alkylene radicals of about 2 to 6 carbon atoms, Y is —NH— or —O—, X is hydrogen, alkali metal or ammonium ion, and n is 0–2.

The collector combination of the present invention provides superior performance in the froth flotation of non-sulfide ores over either component alone and leads to higher recovery and grade at lower dosage requirements. In preferred instances, fatty acid requirements can be reduced by 50% while still providing high mineral recovery and grade.

The first essential ingredient comprising the collector combination of the present invention is a fatty acid derived from a vegetable or animal oil. Illustrative vegetable oils include babassu, castor, Chinese tallow, coconut, corn, cottonseed, grapeseed, hempseed, kapok, linseed, wild mustard, oiticica, olive, ouri-ouri, palm, palm kernel, peanut, perilla, poppyseed, Argentine rapeseed, rubberseed, safflower, sesame, soybean, sugarcane, sunflower, tall, teaseed, tung and ucuhuba oils. Animal oils include fish and livestock oils. These oils contain acids ranging from six to twenty-eight carbon atoms ore more which may be saturated or unsaturated, hydroxylated or not, linear or cyclic and the like.

The second essential ingredient comprising the collector combination of the present invention is an alkylamidoalkyl monoester of a sulfosuccinic acid of the general formula:

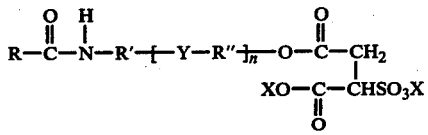

wherein R is an alkyl radical of about 4 to about 18 carbon atoms, R′ and R″ are alkylene radicals of about 2 to 6 carbon atoms, Y is —NH— or —O—, X is hydrogen, alkali metal or ammonium ion, and n is 0–2. Preferred species of the general formula include:

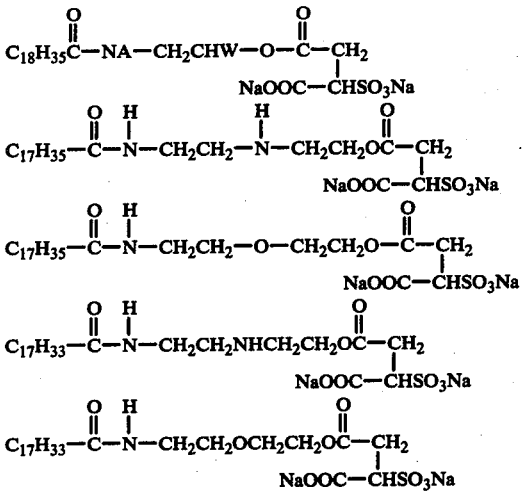

and the corresponding free acids, potassium salts and ammonium salts.

As indicated, the collector combination will comprise from about 1 to about 99 weight percent of fatty acid and, correspondingly, from about 99 to about 1 weight percent of the specified monoester of sulfosuccinic acid or salt thereof. A preferred collector combination is one containing about 90 to 97 weight percent of fatty acid and, correspondingly, from about 10 to about 3 weight percent of the specified monoester.

In carrying out froth flotation of a non-sulfide ore using the collector combination of the present invention, a non-sulfide mineral capable of froth flotation with a fatty acid is selected. Such minerals include phosphate, fluorite, barite, hematite, taconite, magnetite, fluorspar and the like. The selected mineral is screened to provide particles of flotation size according to conventional procedures. Generally, the flotation size will encompass from about 35 to 200 mesh size particles.

After the selected mineral has been sized as indicated, it is slurried in aqueous medium and conditioned with an effective amount of the collector combination. Generally, an effective amount will be in the range of about 0.1 to 2.0 pounds per ton of ore but variations outside this range may occur depending upon such variables as the specific non-sulfide ore processed, the nature and amount of gangue material present, the particular values of recovery and grade desired, the composition of collector combination employed and the like.

In addition to the collector combination, conditioning may also include such other reagents as are conventionally employed. The non-sulfide ores are generally processed at pH values in the range of 6.0 to 12.0, preferably, about 8.0 to 10.0. Accordingly, suitable pH regulators may be used as well as frothers, fuel oil and the like.

After the slurry has been properly conditioned, it is subjected to froth flotation following conventional procedures. The desired mineral values are recovered with the froth and the gangue remains behind.

The invention is more fully illustrated in the examples which follow wherein all parts and percentages are by weight unless otherwise specified. The following general procedure is employed in the froth flotation examples which follow.

GENERAL PROCEDURE

Rougher Float

Step 1: Secure washed and sized feed, e.g., 35 × 150 mesh screen fractions. Typical feed is usually a mixture of 23% coarse with 77% fine flotation particles.

Step 2: Sufficient wet sample, usually 640 grams, to give a dry weight equivalent of 500 grams. The sample is washed once with about an equal amount of tap water. The water is carefully decanted to avoid loss of solids.

Step 3: The moist sample is conditioned for one minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct endpoint. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5: The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

EXAMPLE 1

Following the general procedure, Florida pebble phosphate rock was froth floated following conventional procedures using a fatty acid derived from tall oil in conjunction with No. 5 fuel oil at pH 9.0 as a control standard. As an example of the invention, a collector combination consisting of 92% of tall oil fatty acid and 8% of a sulfosuccinate of the structure:

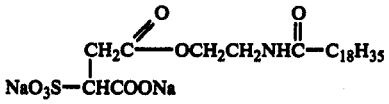

was employed in conjunction with fuel oil. Results and test details are given in Table I.

TABLE I

FLOTATION OF PHOSPHATE ROCK

| Example | Dosages Fatty Acid (lbs/ton) | Dosages Surfactant (lbs/ton) | Dosages Fuel Oil (Lbs/ton) | Weight Recovery (%) | % BPL Feed | % BPL Tail | % BPL Conc. | BPL Recovery (%) | Improvement Over Fatty Acid (%) |
|---|---|---|---|---|---|---|---|---|---|
| Comparative | 0.44 | — | 0.44 | 13.65 | 18.64 | 10.93 | 67.45 | 49.38 | — |
| 1 | 0.405 | 0.035 | 0.44 | 17.98 | 17.89 | 6.78 | 68.58 | 68.92 | 39.6 |

We claim:

1. A collector combination for non-sulfide minerals comprising from about 1 to about 99 weight percent of a fatty acid derived from a vegetable or animal oil and, correspondingly, from about 99 to about 1 weight percent of an alkylamidoalkyl monoester of a sulfosuccinic acid of the general formula:

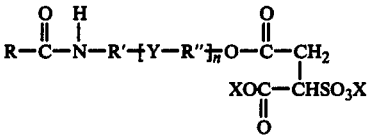

where R is an alkyl radical of 4 to 18 carbon atoms, R′ and R″ are alkylene radicals of 2 to 6 carbon atoms, Y is —NH— or —O—, X is hydrogen, alkali metal or ammonium, and n is 0–2.

2. The collector combination of claim 1 wherein said alkylamidoalkyl monoester of a sulfosuccinic acid has the structure:

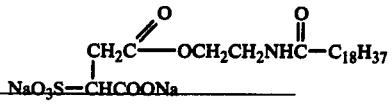

3. The collector combination of claim 1 wherein said fatty acid is derived from tall oil.

4. The collector combination of claim 1 wherein said fatty acid is derived from tall oil and said alkylamidoalkyl monoester of sulfosuccinic acid has the structure:

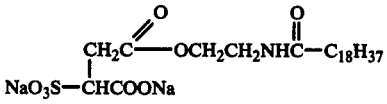

* * * * *